US008994562B1

(12) United States Patent
Daniel et al.

(10) Patent No.: US 8,994,562 B1
(45) Date of Patent: Mar. 31, 2015

(54) BOAT MONITORING SYSTEMS AND METHODS

(71) Applicants: Shane Daniel, Murfreesboro, TN (US); Jonathon Daniel, Murfreesboro, TN (US)

(72) Inventors: Shane Daniel, Murfreesboro, TN (US); Jonathon Daniel, Murfreesboro, TN (US)

( * ) Notice: Subject to any disclaimer, the term of this patent is extended or adjusted under 35 U.S.C. 154(b) by 0 days.

(21) Appl. No.: 13/707,164

(22) Filed: Dec. 6, 2012

Related U.S. Application Data

(60) Provisional application No. 61/567,277, filed on Dec. 6, 2011.

(51) Int. Cl.
*G08B 23/00* (2006.01)

(52) U.S. Cl.
USPC ..... 340/984; 340/539.13

(58) Field of Classification Search
CPC ..... G08G 1/00; G08G 7/008; G08B 23/00
USPC ..... 340/539.1, 539.13, 539.16–539.19, 340/572.1, 425.5, 426.1, 426.11–426.13, 340/438, 439, 903, 984; 235/384, 385; 701/1, 2, 21, 23, 29; 342/357.06, 342/357.07, 357.09, 357.55
See application file for complete search history.

(56) References Cited

U.S. PATENT DOCUMENTS

| | | | | |
|---|---|---|---|---|
| 6,368,526 | B1 | 4/2002 | Bango, Jr. | |
| 6,469,641 | B1 | 10/2002 | Lash et al. | |
| 7,047,114 | B1 * | 5/2006 | Rogers | 701/21 |
| 7,378,960 | B1 * | 5/2008 | Binding et al. | 340/539.13 |
| 7,412,939 | B2 * | 8/2008 | Van Derryt | 114/68 |
| 7,664,815 | B2 * | 2/2010 | Gundersen et al. | 709/204 |
| 8,180,507 | B2 * | 5/2012 | Dokken | 701/21 |
| 8,204,971 | B2 | 6/2012 | Ewing et al. | |
| 8,267,731 | B2 * | 9/2012 | Arvidsson | 440/56 |
| 8,418,064 | B2 | 4/2013 | Guagenti et al. | |

FOREIGN PATENT DOCUMENTS

| | | | |
|---|---|---|---|
| EP | 0877347 | B1 | 8/1998 |
| WO | 2004109317 | A2 | 12/2004 |

* cited by examiner

*Primary Examiner* — Van T Trieu
(74) *Attorney, Agent, or Firm* — Knox Patents; Thomas A. Kulaga

(57) ABSTRACT

A system for monitoring a plurality of boats has a plurality of boat monitoring elements. Each boat monitoring element is mounted on a respective boat and is coupled to various sensors on the same boat. Further, a system controller is configured to communicate with each of the boat monitoring elements via a wireless mesh network. Data indicative of events sensed by the sensors are transmitted to the system controller via such wireless mesh network. The system controller tracks the sensed events and is configured to perform various predefined actions when certain events occur. A remote user may contact the system controller through a wide area network or otherwise to discover the status of a particular boat or to control conditions on the boat.

29 Claims, 5 Drawing Sheets

BOAT MONITORING SYSTEMS AND METHODS

CROSS REFERENCE TO RELATED APPLICATION

This application claims priority to U.S. Provisional Patent Application No. 61/567,277, entitled "Boat Monitoring Systems and Methods" and filed on Dec. 6, 2011, which is incorporated herein by Reference.

RELATED ART

In a typical boat monitoring system, a boat is equipped with various sensors for monitoring certain conditions indicative of the status of the boat. Information from one or more sensors is automatically reported to a land-based controller usually through a cellular channel. Thus, when a predefined event of interest occurs, the controller can learn of the event and take appropriate action. As an example, a sensor may sense a condition indicating that a fire is occurring on the boat, and the controller may provide a warning so that personnel on land are aware of the fire.

Such conventional boat monitoring systems are typically expensive to maintain and operate. In addition, conventional boat monitoring systems also suffer from reliability issues. For example, cellular coverage is limited, particularly for boats, which typically rely on cellular towers on land for communication. Techniques for increasing the robustness and decreasing the costs of boat monitoring systems are generally desired.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

The present disclosure generally pertains to systems and methods for monitoring boats. In one exemplary embodiment, each of a plurality of boats has a respective boat monitoring element that is coupled to various sensors on the same boat. Further, a system controller is configured to communicate with each of the boat monitoring elements via a wireless mesh network. Data indicative of events sensed by the sensors are transmitted to the system controller via such wireless mesh network. The system controller tracks the sensed events and is configured to perform various predefined actions when certain events occur. A remote user may contact the system controller through a wide area network or otherwise to discover the status of a particular boat or to control conditions on the boat.

Figure 1:
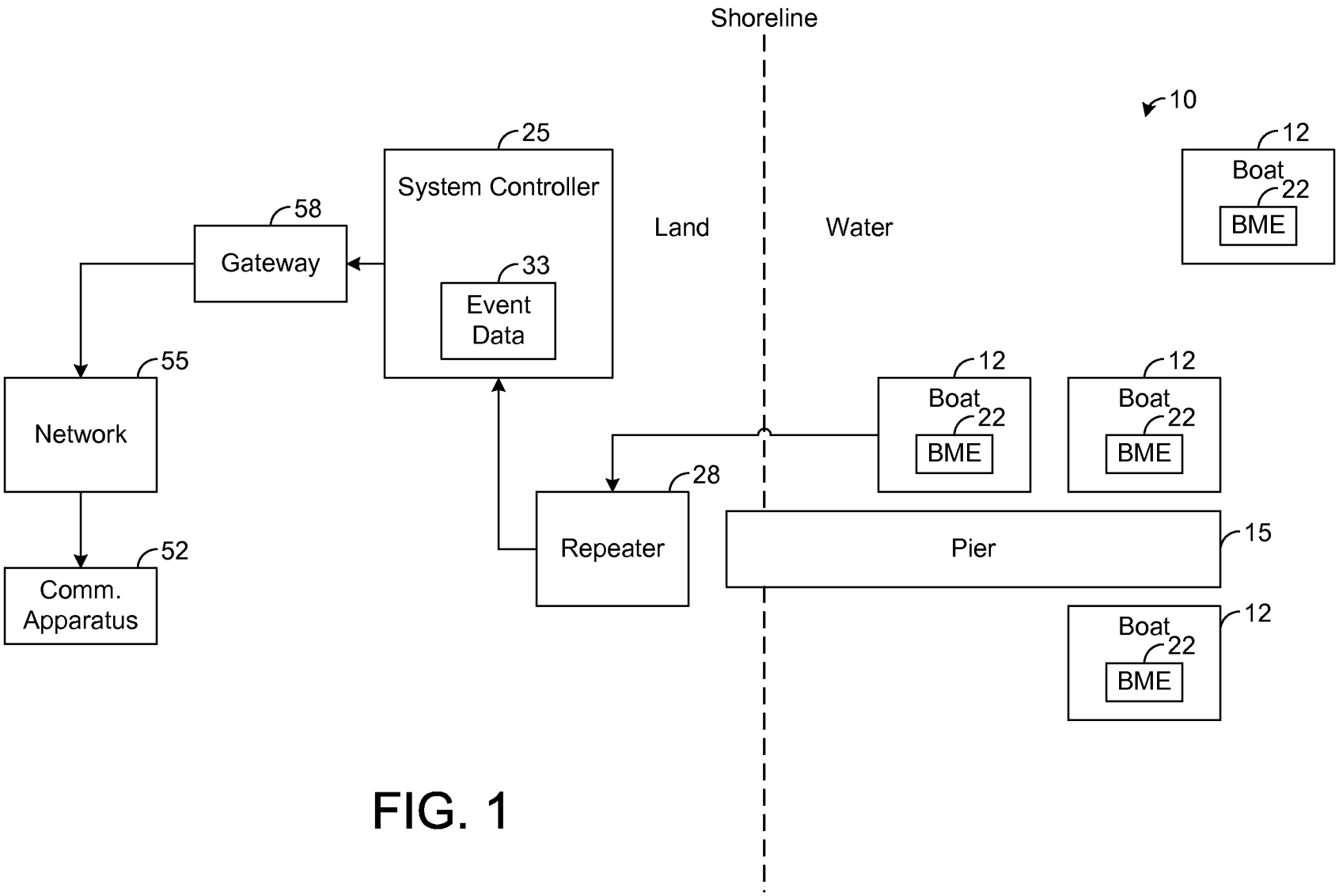
FIG. 1 is a block diagram illustrating an exemplary embodiment of a boat monitoring system.

FIG. 1 depicts an exemplary embodiment of a system 10 for monitoring boats 12. The system 10 may be implemented at a marina or mooring field where boats 12 are typically docked for long periods of time, but the system 10 may be implemented at other locations in other embodiments. The exemplary embodiment shown by FIG. 1 has a plurality of boats 12 floating in water, such as a lake, river, bay, or ocean, and some of the boats are docked at a pier 15 that extends into the water.

Each boat 12 has a boat monitoring element (BME) 22 mounted on the boat 12, such as within the boat's engine compartment, but other locations in or on the boat 12 are possible in other embodiments. As will be described in more detail hereafter, each monitoring element 22 is configured to monitor certain parameters indicative of the boat's safety, security, and/or other type of status and to wirelessly transmit data indicative of such parameters to a system controller 25.

In one exemplary embodiment, the system controller 25 is in close proximity to the boats 12, such as at a marina where the boats are docked. However, other locations of the system controller 25 are possible. Depending on the distance of the system controller 25 from the boats 12 and the signal strength of the wireless signals transmitted from the boats 12, there may be one or more repeaters 28 that may be used to extend the effective communication range of the boat monitoring elements 22. Each such repeater 28 is configured to receive and re-transmit messages from the boat monitoring elements 22 so that the effective communication range of such elements 22 can be extended to reach the system controller 25 if the system controller 25 is out of direct communication range of at least some of the monitoring elements 22.

In addition, in one exemplary embodiment, the boat monitoring controller 25 and the boat monitoring elements 22 on the boats 12 form a wireless mesh network in which each boat monitoring element 22, as well as the system controller 25 and the repeater 28, implements a respective node of the wireless mesh network. In such case, a message from any boat monitoring element 22 can hop through other boat monitoring elements 22 or repeaters 28 to reach the system controller 25. However, other types of networks may be implemented in other embodiments.

In addition, the system controller 25 may be configured to transmit messages to the boat monitoring elements 22. As an example, the controller 25 may transmit control messages causing the boat monitoring elements 22 to perform desired functions or update the boat monitoring elements 22. Also, the controller 25 may request certain information, such as parameters measured by the boat monitoring elements 22. Messages transmitted from the controller 25 may hop through any number of nodes (e.g., boat monitoring elements 22 or repeaters) of the wireless network.

Each boat monitoring element 22 is assigned an identifier that uniquely identifies it from the other boat monitoring elements 22 of the system 10. Based on its monitored parameters, the element 22 detects certain events of interest and reports such events to the system controller 25. As an example, for each detected event, the boat monitoring element 22 may transmit a message for notifying the controller 25 of the occurrence of the event. Such message preferably includes the identifier of the boat monitoring element 22 as well as data indicating the type of event that occurred. The message may also include other information about the event, such as the time and date of the event, as well as the measured parameter on which detection of the event is based. The controller 25 is configured to record information pertaining to the event from the message in data 33, referred to hereafter as "event data."

As an example, the event data 33 may be stored in a database in which a new entry is created for each detected event. Such entry may have a field for storing the identifier of the boat monitoring element 22 that detected the event, as well as one or more fields for indicating the type of event and/or information about the event (e.g., the time of the event and/or the measured parameter on which detection of the event is based). Thus, the event data 33 can be analyzed at any time to determine which events of interest related to the boats 22 have occurred. Further, for each event, the data 33 indicates on which boat 12 the event occurred. In this regard, as described above, the data 33 indicates the identifier of the boat monitoring element 22 that notified the controller 25 of the event, and such identifier can be used to identify the boat 12 on which the event occurred. That is, the identifier included in the notification message identifies, not only the monitoring element 22 that transmitted the message, but also the boat 12 on which such element 22 resides.

In addition to recording events in the event data 33, the controller 25 is configured to analyze the event data 33 for certain predefined alarm conditions. In this regard, it may be desirable for the controller 25 to generate an alarm when a certain type of event occurs or when a certain parameter monitored by any of the boat monitoring elements 22 is within a certain range (e.g., exceeds a threshold). As an example, one of the parameters may indicate that a fire is occurring on a boat 12 when such parameter exceeds the threshold. In such case, the controller 25 may be configured to generate an alarm to warn one or more users of the detected condition when the parameter exceeds the threshold. In other examples, alarms for other conditions may be rendered.

Note that there are various types of alarms that can be generated by the controller 25. As an example, the controller 25 may generate an audio alarm, such as a buzzer, siren, or prerecorded verbal message, and/or a visual alarm, such as activation of a light or strobe or display of a visual (e.g., textual) message. Such alarms may be rendered at the location of the system controller 25 (e.g., at the marina at which the boats 12 are docked or otherwise in close proximity). In addition, the controller 25 may be configured to cause an alarm to be rendered at a remote location. As an example, the system controller 25 may transmit data indicative of an alarm condition to a communication apparatus 52, such as a computer (e.g., laptop, desktop, or hand-held computer), a telephone, a pager, a personal digital assistant (PDA), or other type of device, at a remote location.

In one exemplary embodiment, the system controller 25 is configured to communicate with the apparatus 52 via a network 55, such as a telephone or data network. As an example, the network 55 may comprise the Internet, and the controller 25 may be in communication with a gateway 58 that provides access to the network 55. Upon receiving a message indicative of an alarm condition, the communication apparatus 52 generates an alarm (e.g., an audio or visual message or warning) to warn the user of the apparatus 52 about the alarm condition. Various other techniques for conveying alarms to users are possible in other embodiments.

Figure 2:
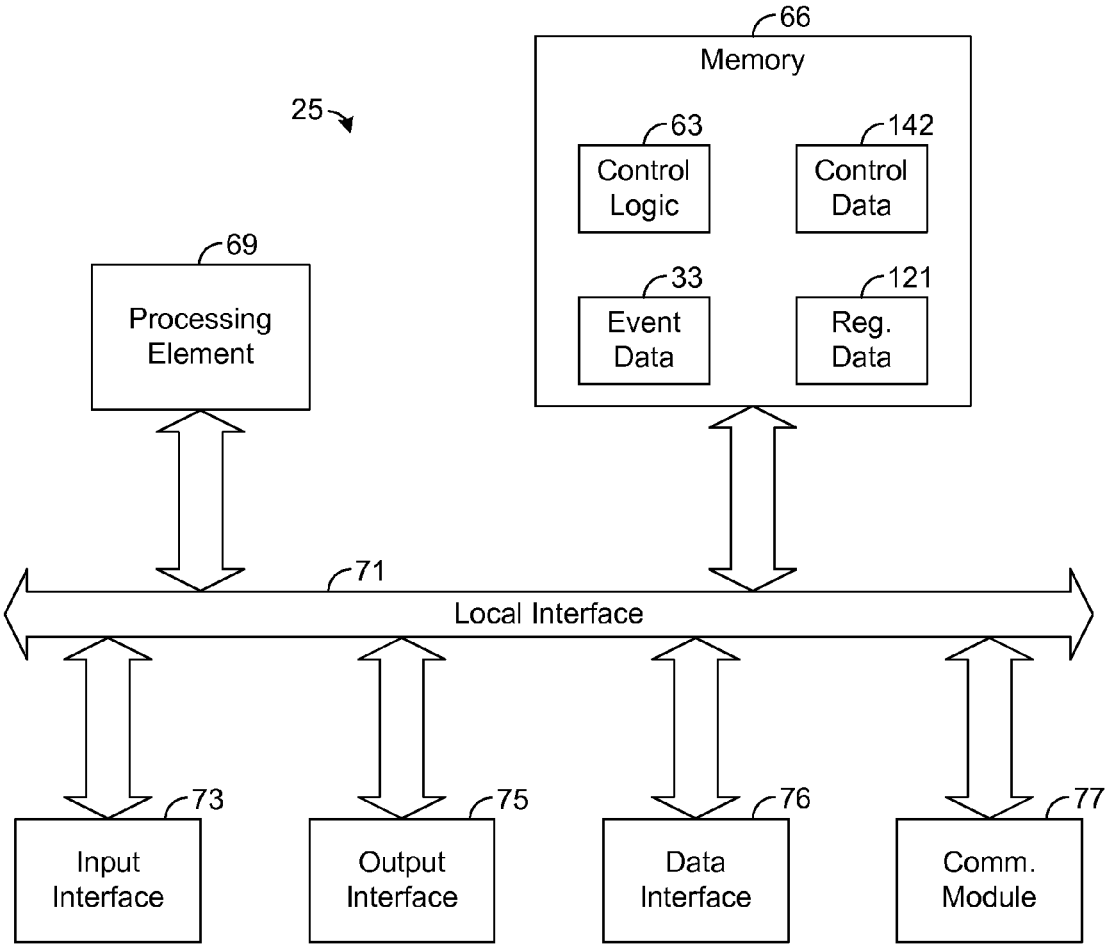
FIG. 2 is a block diagram illustrating an exemplary embodiment of a system controller, such as is depicted by FIG. 1.

FIG. 2 depicts an exemplary embodiment of the system controller 25. The controller 25 may be implemented via a computer, such as a laptop, desktop, or hand-held computer, though other types of devices may be used to implement the system controller 25 in other embodiments. As shown by FIG. 2, the controller 25 comprises control logic 63 for generally controlling the operation and functionality of the controller 25, as will be described in more detail below. The logic 63 can be implemented in software, hardware, firmware, or any combination thereof. In the exemplary embodiment illustrated in FIG. 2, the control logic 63 is implemented in software and stored in memory 66 of the system controller 25.

Note that the control logic 63, when implemented in software, can be stored and transported on any computer-readable medium for use by or in connection with an instruction execution apparatus that can fetch and execute instructions. In the context of this document, a "computer-readable medium" can be any means that can contain or store a program for use by or in connection with an instruction execution apparatus.

The exemplary embodiment of the system controller 25 depicted by FIG. 2 comprises at least one conventional processing element 69, such as a digital signal processor (DSP) or a central processing unit (CPU), that communicates to and drives the other elements within the controller 25 via a local interface 71, which can include at least one bus. Furthermore, an input interface 73, for example, a keyboard, keypad, or a mouse, can be used to input data from a user of the controller 25, and an output interface 75, for example, a printer or a display device, e.g., a liquid crystal display (LCD), can be used to output data to the user. In addition, a data interface 76 can be used to interface data with the controller 25. As an example, the data interface 76 may be coupled to the gateway 58 (FIG. 1) for enabling communication between the gateway 58 and the controller 25.

As shown by FIG. 2, the system controller 25 also comprises a communication module 77 that is configured to communicate wireless signals (e.g., radio frequency (RF) signals). Such module 77 may be used for communication between the controller 25 and the boat monitoring elements 22.

Figure 3:
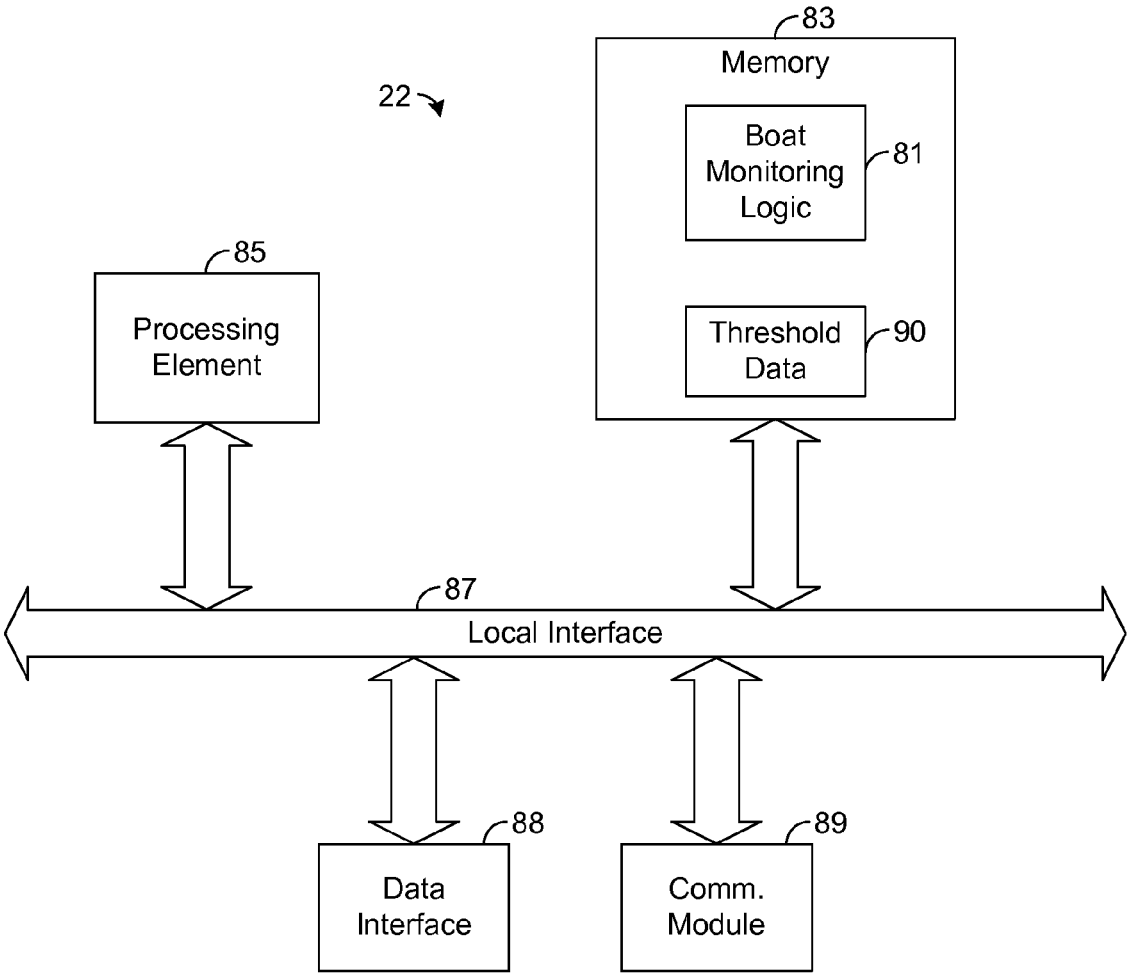
FIG. 3 is a block diagram illustrating an exemplary embodiment of a boat monitoring element, such as is depicted by FIG. 1.

FIG. 3 depicts an exemplary embodiment of a boat monitoring element 22. As shown by FIG. 3, the element 22 comprises boat monitoring logic 81 for generally controlling the operation and functionality of the element 22, as will be described in more detail below. The logic 81 can be implemented in software, hardware, firmware, or any combination thereof. In the exemplary embodiment illustrated in FIG. 3, the boat monitoring logic 81 is implemented in software and stored in memory 83 of the boat monitoring element 22. Note that the boat monitoring logic 81, when implemented in software, can be stored and transported on any computer-readable medium for use by or in connection with an instruction execution apparatus that can fetch and execute instructions.

The exemplary embodiment of the boat monitoring element 22 depicted by FIG. 3 comprises at least one conventional processing element 85, such as a digital signal processor (DSP) or a central processing unit (CPU), that communicates to and drives the other elements within the element 22 via a local interface 87, which can include at least one bus. Furthermore, a data interface 88 can be used to interface data with the element 22. The boat monitoring element 22 also stores in memory 83 predefined threshold data 90 that defines a plurality of thresholds used to detect certain events, as will be described in more detail below.

As shown by FIG. 3, the boat monitoring element 22 also comprises a communication module 89 that is configured to communicate wireless signals (e.g., radio frequency (RF) signals). Such module 89 may be used for communication between the element 22 and the boat monitoring controller 25.

In one exemplary embodiment, the boat monitoring element 22 has a housing (not shown) for housing components of the element 22, such as the memory 83, processing element 85, and communication module 89. Further, the data interface 88 may be housed by or coupled to (e.g., mounted on) the housing. In one embodiment, the housing is environmentally hardened to help protect the components of the boat monitoring element 22 from environmental conditions. In particular, the housing is preferably sealed such that it prevents water from entering the housing and contacting the housed components. However, the data interface 88 may be exposed so that it can be connected to external components, as will be described in more detail below.

Figure 4:
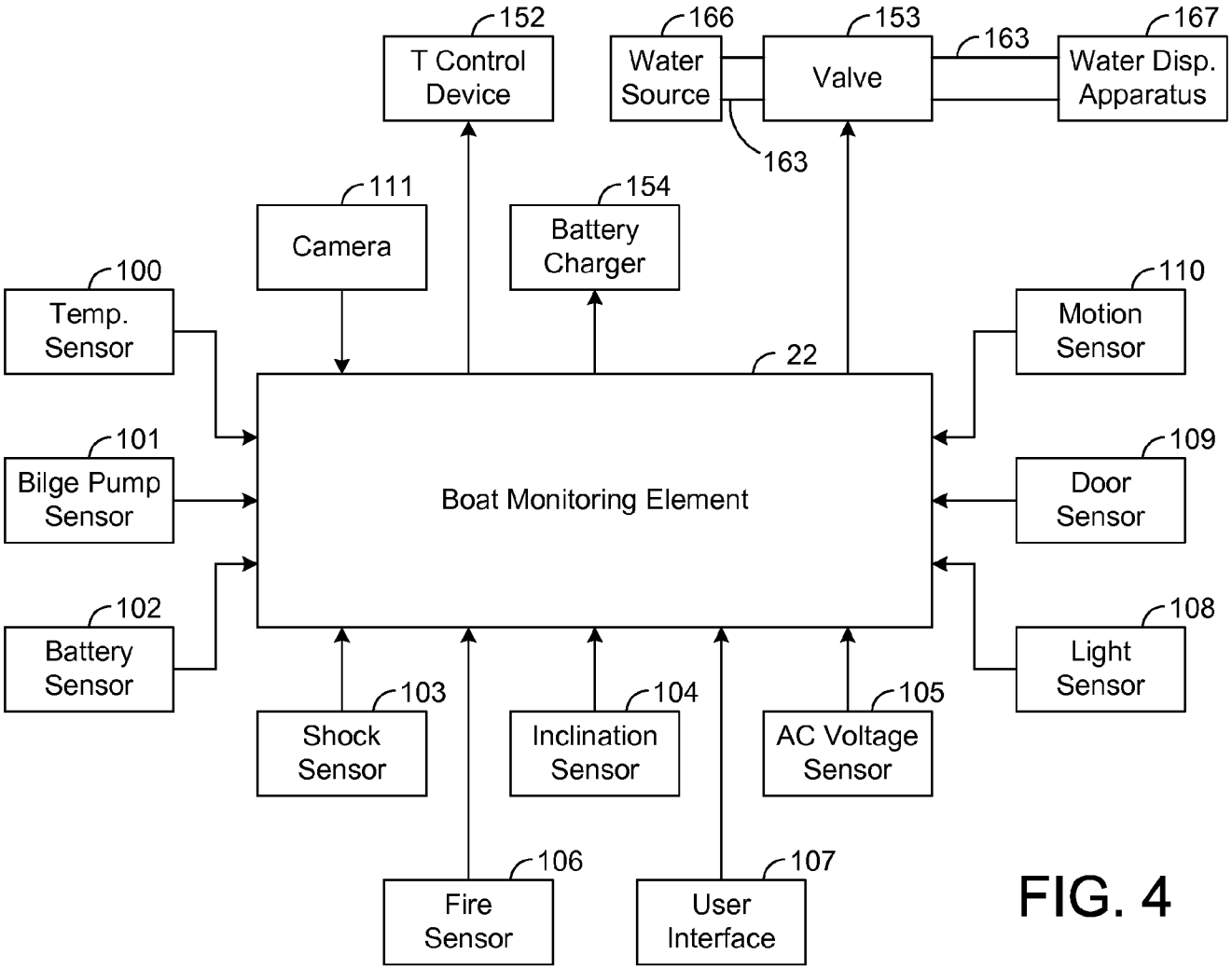
FIG. 4 is a block diagram illustrating a boat monitoring element, such as is depicted by FIG. 3, coupled to a plurality of sensors for monitoring conditions on a boat.

As shown by FIG. 4, the boat monitoring element 22 (e.g., the data interface 88 of FIG. 3) is coupled to a plurality of devices 100-111 from which the element 22 receives data (e.g., sensor data) about the boat 12 on which the element 22 resides. Based on such data, the element 22 monitors certain parameters and detects events of interest based on such parameters. The boat monitoring element 22 further reports the detected events to the system controller 25 (FIG. 1). In one exemplary embodiment, the boat monitoring element 22 is positioned in the engine compartment of a boat 12, but other locations of the element 22 are possible in other embodiments. Further, the boat monitoring element 22 is coupled to the devices 100-111 via conductive connections, but other types of connections (e.g., optical and/or wireless) may be used, if desired.

Referring to FIG. 4, the boat monitoring element 22 is coupled to a bilge pump sensor 101, which is coupled to a bilge pump (not shown) of the boat 12 on which the element 22 resides. As known in the art, a boat's bilge pump is configured to pump out of the boat 12 water that is within the boat's hull. A bilge pump may be configured to sense the presence of water within the hull and to then automatically activate in response to such detection. Moreover, high usage (e.g., a high rate of activation and/or long activation durations) of the bilge pump can indicate a problem, such as a leaking hull.

The bilge pump sensor 101 is configured to detect when the bilge pump is operating, and the boat monitoring logic 81 is configured to report to the system controller 25 events pertaining to the operation of the bilge pump based on the sensor 101. As an example, the logic 81 may report the operation times to the controller 25. As an example, for each activation cycle of the bilge pump, the logic 81 may report such cycle and indicate the duration of the cycle. If the controller 25 determines that the bilge pump usage is abnormal (e.g., operating at an abnormally high frequency and/or for abnormally long periods of time), the controller 25 may generate an alarm for warning a user of the abnormal use of the bilge pump.

As an example, in one exemplary embodiment, the logic 81, based on the messages from the boat monitoring element 22, calculates a value indicative of an amount of usage of the bilge pump over time (e.g., over many activation cycles of the bilge pump), such as during a certain time period (e.g., the last three months). Further, the logic 81 compares the value to a predefined threshold. If the value exceeds the threshold, then the logic 81 determines that the bilge pump usage is abnormal and generates an alarm. However, if the value is less than threshold, then the logic 63 does not generate an alarm.

Note that there are various techniques that can be used to determine when the bilge pump is operating. In one exemplar embodiment, the bilge pump is powered by a battery. When activated, the bilge pump draws current from the battery. The bilge pump sensor 101 is configured to detect when the bilge pump is drawing at least a threshold amount of current. As an example, the sensor 101 may be configured to detect the current or voltage of a wire connecting the bilge pump to the battery and determine that the bilge pump is operating when the detected parameter exceeds a predefined threshold. Yet other techniques for sensing the operation of the bilge pump are possible in other embodiments.

The boat monitoring element 22 is also coupled to a battery sensor 102, which is used to monitor a voltage of the boat's battery (not shown). If the sensed voltage falls below a predefined threshold, as indicated by the threshold data 90, then the boat monitoring logic 81 reports such event to the system controller 25. The occurrence of this event may indicate that the battery has been sufficiently discharged such that imminent replacement of the battery is needed or desired. The controller 25 may be configured to trigger an alarm in response to the occurrence of such an event.

As shown by FIG. 4, the boat monitoring element 22 is further coupled to a shock sensor 103, which is configured to sense when the boat 12 experiences a significant shock such as when the boat 12 collides with an object (e.g., another boat 12 or land). In one exemplary embodiment, the shock sensor 103 is implemented via an accelerometer that detects acceleration. If the sensed acceleration exceeds a threshold, as indicated by the threshold data 90, then the boat monitoring logic 81 reports such event to the system controller 25. The occurrence of this event may indicate that the boat 12 has just been involved in an accident. The controller 25 may be configured to trigger an alarm in response to the occurrence of such event.

The boat monitoring element 22 is coupled to an inclination sensor 104, which is configured to sense an inclination angle or tilt of the boat 12. In one exemplary embodiment, the inclination sensor 104 is implemented via an accelerometer that is calibrated to a level reference point. The inclination sensor 104 alternatively could be implemented by a conventional mercury switch that is configured to measure tilt. Other types of known sensors for measuring tilt may be used. If the sensed inclination angle exceeds a threshold, as indicated by the threshold data 90, then the boat monitoring logic 81 reports such event to the system controller 25. The occurrence of this event may indicate that the boat 12 is listing. The controller 25 may be configured to trigger an alarm in response to the occurrence of such event.

The boat monitoring element 22 is also coupled to an alternating current (AC) voltage sensor 105, which is configured to sense the AC voltage of the water near the boat 12. In this regard, due to an electrical fault or otherwise, it is possible for the boat's electrical system or other electrical source in the vicinity of the boat 12 to apply a voltage to the water at a high enough level to be dangerous to people who come into contact with the water. In one exemplary embodiment, the AC voltage sensor 105 has a pair of electrodes (not shown) that are positioned in the water, and the sensor 105 measures the AC voltage across the electrodes. If the sensed voltage exceeds a threshold, as indicated by the threshold data 90, then the boat monitoring logic 81 reports such event to the system controller 25, and the controller 25 may be configured to trigger an alarm in response to the occurrence of such event.

The boat monitoring element 22 is further coupled to a fire sensor 106, which is configured to sense when the boat 12 on fire. In one exemplary embodiment, the fire sensor 106 is implemented via a smoke detector or an oxygen detector. If the sensed level of smoke exceeds a threshold, as indicated by the threshold data 90, or if the sensed level of oxygen falls below a threshold, as indicated by the threshold data 90, then the boat monitoring logic 81 reports such event to the system controller 25. The controller 25 may be configured to trigger an alarm in response to the occurrence of such event.

Note that a temperature sensor 100 also may be used to indicate a fire condition on board the boat. If the sensed temperature exceeds a threshold, as indicated by the threshold data 90, then the boat monitoring logic 81 reports such event to the system controller 25, and the controller 25 may be configured to trigger an alarm in response to the occurrence of such event. In some embodiments, the boat monitoring logic 81 is configured to monitor a plurality of sensors to determine when a fire event is occurring and to then report the event based on such determination. As an example, if the level of smoke is within a certain range, as indicated by the threshold data 90, then the boat monitoring logic 81 may be configured to report the occurrence of a fire only if the temperature sensed by the sensor 100 exceeds a certain threshold, as indicated by the threshold data 90. The controller 25 may be configured to trigger an alarm in response to the occurrence of such event. However, if the level of smoke is greater than the range indicated in the foregoing example, then the controller 25 may be configured to trigger an alarm regardless of the state of the temperature sensor 100 alternatively the threshold used for the temperature sensor 100 may be lowered.

In addition to reporting hot temperatures, the boat monitoring logic 81 may also be configured to report when the temperature measured by the sensor 100 falls below a threshold, as indicated by the threshold data 90. The controller 25 may be configured to trigger an alarm in response to the occurrence of such event.

In some situations, it may be desirable to know when a person is on board the boat 12. In this regard, a boat 12 may be left at the marina or other location unattended, and it may be desirable to know if an unauthorized person has boarded the boat 12. In one exemplary embodiment, the boat monitoring element 22 is coupled to a user interface 107 that allows a user to exchange data with the boat monitoring element 22. As an example, the user interface 107 may have a keypad for allowing a user to provide inputs. The user interface 107 may also have a display (e.g., a liquid crystal display (LCD)) and/or speaker for allowing outputs to be displayed or otherwise rendered to the user. Any of the events detected by the boat monitoring element 22 may be reported to the user interface 107 in addition to or in lieu of the controller 25 so that a user on board the boat 12 can be informed of such detected events.

In one embodiment, an authorized user uses the interface 107 to indicate when certain sensors should be monitored, and such sensors indicate the presence of a person on board the boat 12. As an example, such sensors may include a light sensor 108, a door sensor 109, and/or a motion sensor 110. When the user desires the sensors to be monitored, the user provides an input that causes the boat monitoring logic 81 to begin monitoring the sensors 108-110. When the user no longer desires the logic 81 to monitor the sensors 108-110, the user provides another input that causes the logic 81 to stop monitoring the sensors 108-110. As an example, the user may activate monitoring of the sensors 108-110 upon leaving the boat 12 and then deactivate the sensors 108-110 upon returning to the boat 12. Thus, if any of the sensors 108-110 detect the presence of a person while monitoring of such sensor is activated, then it is likely that such person is an intruder who is not authorized to be on the boat 12. The boat monitoring logic 81 is configured to report such event to the controller 25, and the controller 25 may be configured to trigger an alarm in response to the occurrence of such event.

The light sensor 108 is configured to sense light. The sensor 108 may be positioned in the boat's engine compartment or inside stateroom. If a door is opened to the room in which the sensor 108 is located, light may enter the room through the door causing the amount of light measured by the sensor 108 to increase. If the sensed light exceeds a threshold, as indicated by the threshold data 90, while the sensor 108 is being monitored, then the boat monitoring logic 81 reports such event to the system controller 25, and the controller 25 may be configured to trigger an alarm in response to the occurrence of such event.

The door sensor 108 is configured to sense when a door of the boat is opened. Such a sensor 108 may be implemented by a contact switch or some other switch commonly used to sense when doors or windows are opened. If the sensor 108 senses opening of a door while it is being monitored, then the boat monitoring logic 81 reports such event to the system controller 25, and the controller 25 may be configured to trigger an alarm in response to the occurrence of such event.

The motion sensor 110 is configured to sense motion. There are various types of sensors known for performing this function. In one exemplary embodiment, the motion sensor 110 is implemented via an infrared sensor, but other types of sensors may be used in other embodiments. If the sensor 110 detects motion while it is being monitored, then the boat monitoring logic 81 reports such event to the system controller 25, and the controller 25 may be configured to trigger an alarm in response to the occurrence of such event.

In one exemplary embodiment, the boat monitoring element 22 is coupled to a camera 111 that is mounted on the boat 12 and configured to capture images. The camera 111 may capture still frames and/or video images. The images captured by the camera 111 may be stored by the boat monitoring element 22 for later retrieval, if desired. In one exemplary embodiment, the images are stored to a circular buffer in which the images are overwritten by new images over time. The images may be written to the buffer continuously or at certain times. As an example, the images captured by the camera 111 may be written to the buffer periodically or in response to a detection by any of the sensors 108-110 for sensing the presence of an unauthorized person.

If desired, the images captured by the camera 111 may be transmitted by the boat monitoring logic 81 to the controller 25. The images may be continuously transmitted, such as for example to provide a live feed. Alternatively, the images may be transmitted periodically or in response to a detection by any of the sensors 108-110 for sensing the presence of an unauthorized person. The controller 25 may be configured to display and/or store the received images.

In one exemplary embodiment, the boat monitoring element 22 is coupled to a plurality of devices 152-154 for which the element 22 provides control input. As an example, the boat monitoring element 22 may be coupled to a temperature control device 152 that is configured to control air temperature within a compartment or room of the boat 12. As an example, the temperature control device 152 may comprise a thermostat that is configured to control a heating or cooling system (not shown) on board the boat 12 for heating or cooling air in one or more rooms or compartments of the boat 12. The boat monitoring logic 81 may directly control the activation state of the heating or cooling system or control the activation state indirectly by controlling the set point of the thermostat or otherwise.

As known in the art, a "set point" generally refers to a temperature threshold that is used to control the activation state of a heating or cooling system. For example, if the temperature sensed by a thermostat falls below a set point for a heating system, the thermostat is configured to activate the heating system thereby causing it to emit heat. Once the sensed temperature rises above the set point, the thermostat is configured to deactivate the heating system. Thus, the heating system maintains room temperature within a range close to the set point. Similarly, the thermostat controls a cooling system to maintain room temperature close to a set point by activating the cooling system when the sensed temperature rises above the set point and by deactivating the cooling system when the sensed temperature falls below the set point. Note that multiple set points (e.g., upper and lower set points) may be used to provide a desired amount of hysteresis.

In one exemplary embodiment, the boat monitoring logic 81 controls the temperature control device 152 based on information from the system controller 25. As an example, the system controller 25 may store control data 142 (FIG. 2) that is generally defined to indicate how various devices on board each boat 12 is to be controlled. The control data 142 may be defined individually for each boat 12 so that one boat 12 can be controlled differently from another. The portion of the control data 142 pertaining to a particular boat 12 is preferably correlated in the data 142 with the boat's identifier so that the identifier may be used as a key to search and find such portion.

For illustrative purposes, assume that for one of the boats 12 the control data 142 (FIG. 2) defines a temperature schedule indicating that the set point used by the temperature control device 152 is to change over time. In this regard, the set point may be set to one temperature at night and a different temperature during the day. Alternatively, the set point or points used during winter may be different than those used during summer. In any event, based on the control data 142, the control logic 63 of the system controller 25 determines the appropriate set point for the present time period. If the set point is to change relative to the current set point being used by the temperature control device 152, the control logic 63 of the system controller 25 is configured to transmit a message to the boat monitoring element 22, which then communicates with the temperature control device 152 to appropriately change the set point.

In another exemplary embodiment, the system controller 25 determines a temperature on board the boat via the temperature sensor 100, as described above or otherwise. The control logic 63 of the system controller 25 then compares the sensed temperature to a current set point indicated by the control data 142 and, based on such comparison, determines whether the activation state of the boat's heating or cooling system is to change. If it is to change, the control logic 63 of the system controller 25 transmits a message to the boat monitoring element 22, which then communicates with the temperature control device 152 is order to cause the device 152 to activate or deactivate the heating or cooling system as appropriate. In such an embodiment, the temperature control device 152 may be configured to transmit an enable signal to the heating or cooling system. If the enable signal is asserted, the heating or cooling system is activated. However, if the enable signal is deasserted, the heating or cooling system is deactivated.

In yet other embodiments, a user may provide inputs via the communication apparatus 52 or otherwise for controlling the heating or cooling system. As an example, the user may provide an input for setting the set point used to control the operation of the heating or cooling system. Alternatively, the user input may request that the activation state of the heating or cooling system be changed. In response to the user input, the system controller 25 is configured to communicate with the boat monitoring element 22, as described above, so that the heating or cooling system is controlled in the desired manner via the temperature control device 152. Yet other techniques may be used to control the operation of the temperature control device 152 in other embodiments.

As shown by FIG. 4, in one exemplary embodiment, the boat monitoring element 22 is coupled to and controls the state of a valve 153 that is used to control water flow through water pipes 163, which pass water from a water source 166 (e.g., a tank or a body of water in which the boat 12 is floating) to a water dispensing apparatus 167, such as a faucet. In this regard, during periods of cold weather, it is possible for water within the pipes 163 to freeze into ice causing the pipes to later burst when the ice begins to thaw. In such case, water may undesirably continue leaking from the pipes 163 into the boat 12.

The valve 153 is configured to selectively block the flow of water through the pipes 163 based on a control signal received from the boat monitoring element 22. In this regard, the boat monitoring element 22 transmits a control signal for selectively transitioning the valve 153 between an open state and a closed state. When in the open state, the valve 153 permits water to flow so that water from the water source 163 may flow through the pipes 163 and valve 153 to the water dispensing apparatus 167. When in the closed state, the valve 153 blocks water from flowing so that water is prevented from flowing past the valve 153 to the water dispensing apparatus 167. When the valve 153 is in the closed state, bursting of the pipes 163 due to cold weather may be prevented and/or, if there is a leak in the pipes 163 between the valve 153 and the water dispensing apparatus 167, water may be prevented from leaking from the pipes 163 into the boat 12.

In one exemplary embodiment, the boat monitoring logic 81 controls the valve 153 based on information from the system controller 25. In this regard, the control data 142 is defined to indicate when the valve 153 is to be transitioned from one state to another. As an example, the control data 142 may indicate that the valve 153 is to be transitioned to the closed state when the temperature sensed by the temperature sensor 100 falls below a predefined threshold. In such embodiment, when the system controller 25 receives a message from the boat monitoring element 22 indicating that the temperature sensor 100 has sensed a temperature below the threshold, the control logic 63 of the controller 25 is configured to transmit a message to the boat monitoring element 22 indicating that the valve 153 is to be transitioned to the closed state. In response, the boat monitoring logic 81 transmits a control signal to the valve 153 for transitioning it to the closed state. Thus, when the sensed temperature falls below the threshold, the valve 153 is automatically transitioned to the closed state.

In another example, the state of the valve 153 is controlled based on time. In this regard, the control data 142 may define a schedule for controlling the state of the valve 153. For example, the boat 12 may be "winterized" by transitioning the valve 153 to the closed state at the beginning of winter, and the valve 153 may be later transitioned to the open state at the end of winter. In such case, the control data 142 indicates the dates that the valve 153 is to be respectively opened and closed, and the system controller 25, based on such data 142, is configured to communicate with the boat monitoring element 22 such that the state of the valve 153 is automatically transitioned at the appropriate times.

In yet other embodiments, a user may provide inputs via the communication apparatus 52 or otherwise for controlling the state of the valve 153. As an example, the user may provide an input for either opening or closing the valve 153. In response to the user input, the control logic 63 of the system controller 25 is configured to communicate with the boat monitoring element 22, as described above, so that the boat monitoring logic 81 transitions the valve 153 to the desired state. Yet other techniques may be used to control the state of the valve 153 in other embodiments.

As shown by FIG. 4, the boat monitoring element 22 is also coupled to and controls a battery charger 154 that is coupled to and used to charge the boat's battery (not shown). In this regard, the boat monitoring element 22 transmits a control signal for selectively transitioning the battery charger 154 between a charging state and an idle state. When in the charging state, the battery charger 154 charges the battery. When in the idle state, the battery charger 154 refrains from charging the battery.

In one exemplary embodiment, the boat monitoring element 22 controls the battery charger 154 based on information from the system controller 25. In this regard, the control data 142 is defined to indicate that the boat's battery is to be charged when the battery sensor 102 senses a voltage or other parameter below a predefined threshold. In such embodiment, when the system controller 25 receives a message from the boat monitoring element 22 indicating that the battery sensor 102 has sensed a voltage below the threshold, the control logic 63 of the controller 25 is configured to transmit a message to the boat monitoring element 22 indicating that the battery charger 154 is to be transitioned to the charging state. In response, the boat monitoring logic 81 transmits a control signal to the battery charger 154 for transitioning it to the charging state. Thus, when the sensed voltage falls below the threshold, the battery charger 154 is controlled such that it automatically begins charging the battery. Once an upper voltage threshold is reached due to the charging, a similar process may be used in order to control the battery charger 154 such that it stops charging the battery.

In yet other embodiments, a user may provide inputs via the communication apparatus 52 or otherwise for controlling the state of the battery charger 154. As an example, the user may provide an input for causing the battery charger 154 to either begin charging the battery or to stop charging the battery. In response to the user input, the control logic 63 of the system controller 25 is configured to communicate with the boat monitoring element 22, as described above, so that the boat monitoring logic 81 transitions the battery charger 154 to the desired state. Yet other techniques may be used to control the state of the battery charger 154 in other embodiments.

In one exemplary embodiment, each boat 12 is registered with the system controller 25 in a registration process that precedes monitoring of such boat 12 by the controller 25. During registration, the identifier of the boat's monitoring element 22 (which also identifies the boat 12 and is used in the communication between such BME 22 and the controller 25) is stored in registration data 121 (FIG. 2) maintained by the controller 25. The entry in the registration data 121 also includes other data pertaining to the monitoring of the identified boat. As an example, the data 121 may include the name and contact information of a person (e.g., the boat owner) associated with the identified boat 12. The entry also may include information about a financial account (e.g., credit card account) that can be used to charge fees. As an example, the services provided by the controller 25 may be charged to such financial account periodically. The entry also may include information (e.g., telephone number, pager number, email address, etc.) for enabling the controller 25 to send an alarm message to the communication apparatus 52. When the controller 25 receives a message indicating an occurrence of an event for which the controller 25 is to report an alarm, the control logic 63 uses the boat identifier included in the message to lookup in the registration data 121 the contact information to be used to send the alarm. The logic 63 then sends the alarm using such contact information.

The registration data 121 is also used by the control logic 63 to track when boats 12 that have not registered with the controller 25 have entered or come within close proximity of the marina or other location. Such an occurrence may be a security threat, particularly during certain hours of the day (such as at night or early morning) when significant traffic is not expected, or may indicate that someone is improperly using or exploiting the services of the marina.

Note that there are a variety of techniques that can be used to determine whether a boat 12 is within a particular region of interest, such as within close proximity of a marina. As an example, the boat monitoring element 22 may be coupled to a location sensor, such as a global positioning system (GPS) sensor, and the boat monitoring logic 81 may determine and report to the controller 25 the location of the boat 12 based on such location sensor. In another embodiment, a node of the network (such as the repeater 28) at a fixed location communicates with the boat monitoring element 22 and measures the signal strength of a signal received from such element 22 to estimate the distance of the boat 12 from such node. Based on such distance, the control logic 63 can determine whether the boat 12 is within the marina or other region of interest.

Various other techniques may be used to determine the distance between the boat and a fixed location, such as a repeater 28. For example, there exist various ranging algorithms where two nodes communicate with each other to determine the distance between the nodes. In some embodiments, the time of flight of messages communicated between the two nodes is measured in order to calculate the distance between the two nodes. Essentially, the distance is greater for longer times of flight. In another embodiment, the distance is estimated based on the phase relationship of signals communicated between the nodes. Any such ranging algorithms may be employed to determine the distance of the boat 12 from a fixed location, such as the repeater 28.

Moreover, if the control logic 63 receives a message from a boat 12 that is within the region of interest but not identified by the registration data 121, then the logic 63 identifies such boat 12 as "unregistered." For as long as the unregistered boat 12 remains in the region of interest (e.g., at the marina or within a predefined distance of the repeater 28 or other node), the control logic 63 tracks the boat 12 and stores information about the boat 12. As an example, the logic 63 may store the boat's identifier and the times that the boat 12 is detected to be within the region of interest. If the boat 12 continuously stays in such region of interest for longer than a specified duration, then the control logic 63 triggers an alarm to notify a user of such event. In response, the user may look for the identified boat 12 and investigate whether the boat's personnel are improperly using or exploiting the services of the marina.

In another example, if an unregistered boat 12 is within the region of interest during certain time periods, such as at night, the control logic 63 may be configured to trigger an alarm. There are various other actions that the control logic 63 could take in response to a detection of an unregistered boat 12.

Note that the controller 25 can be configured to track registered boats 12 at any location from which a given boat 12 is within range of the controller 25. Such range can vary as boats 12 move since a given boat 12 can communicate with the controller 25 through the BMEs 22 of other boats 12. In fact, a boat 12 can be a long distance from the controller 25 such that direct communication with the controller 25 is not possible but nevertheless still communicate with the controller 25 by hopping messages through the BMEs 22 of other boats 12. However, in one exemplary embodiment, the control logic 63 is configured to only monitor boats 12 that are within a certain region of interest (e.g., at or within a certain distance of the marina).

In this regard, the control logic 63 may be configured to determine whether a given registered boat 12 is within a region of interest using any of the techniques described above for determining whether an unregistered boat 12 is within a region of interest. As long as a registered boat 12 remains within such region of interest, the control logic 63 communicates with the boat's BME 22 and tracks events of interest, as described herein. Further, the control logic 63 may trigger an alarm for any such event. However, once the boat 12 leaves the region of interest, the control logic 63 stops tracking the boat 12. That is, the control logic 63 stops updating the event data 33 based on communications with the boat's BME 22, as well as stops analyzing data from the boat 12 for determining whether to trigger an alarm. However, once the boat 12 re-enters the region of interest or enters another region of interest, the control logic 63 resumes monitoring the boat 12, as is described herein. Note that selective monitoring of the boat 12 is optional, and in other embodiments, the control logic 63 may be configured to continuously monitor a given boat 12 for as long as it remains in communication with the system controller 25.

Figure 5:
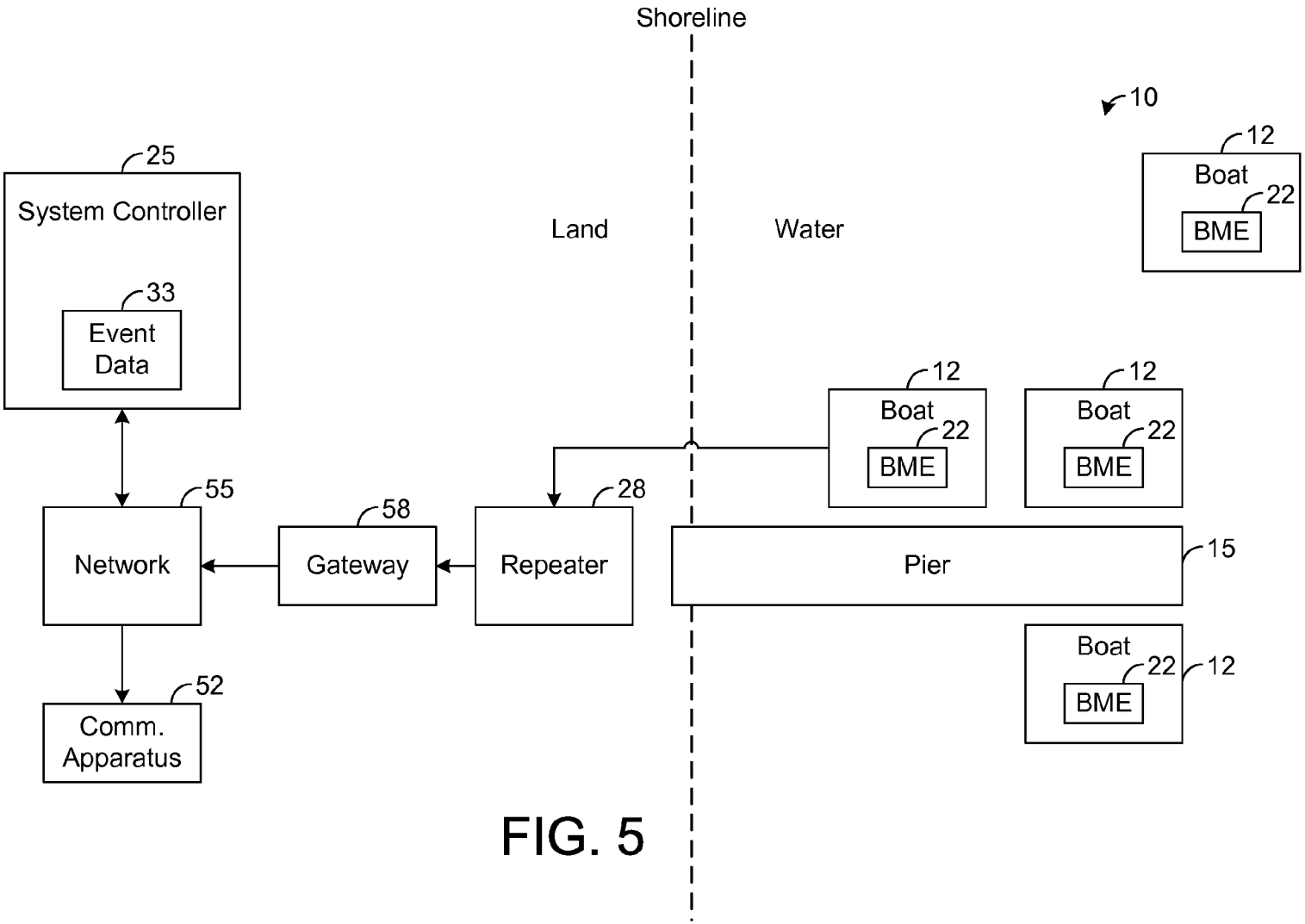
FIG. 5 is a block diagram illustrating an exemplary embodiment of a boat monitoring system.

FIG. 5 depicts another exemplary embodiment of a boat monitoring system 10. As can be seen by comparing FIG. 1 and FIG. 5, the system 10 of FIG. 5 is similar to that of FIG. 1 except that the boat monitoring controller 25 is located at a remote location and communicates with the boat monitoring elements 22 through the network 55, such as for example the Internet. In such example, the gateway 58 encapsulates the messages from the boat monitoring elements 22 into IP packets (or other protocol compatible with the network 55) for transmission through the network 55.

In one exemplary embodiment, the system controller 25 hosts a website that can be used to access the event data 33. As an example, a user of the communication apparatus 52 or other device can contact the system controller 25 via the network 55 and access the event data 33. In one exemplary embodiment, the user is authenticated for a particular boat 12 and is allowed to access only the data 33 pertaining to the boat 12 for which he or she is authenticated.

In another exemplary embodiment, a system controller 25 may be implemented remotely, as shown by FIG. 5, and also locally, as shown by FIG. 1. Thus, personnel at the marina may locally monitor the boats 12 while users (e.g., boat owners, personnel of insurance companies insuring the boats 12, or others) can monitor the boats 12 remotely. If desired, an system controller 25 may be implemented locally, and upload the event data 33 to a remote server via the network 55 to provide access to the data 33 for remote users. Also, a system controller 25 implemented locally, as shown by FIG. 1, could be configured to host a website or otherwise provide remote access to the event data 33 such that implementation of a remote server is unnecessary.

It should be noted that, for any given alarm, the decision of when to generate the alarm and/or which detected events should trigger the alarm may be made by control logic 63 or the boat monitoring logic 81. For example, upon detecting the occurrence of an event that should trigger an alarm, the boat monitoring logic 81 may be configured to transmit a message for instructing the control logic 63 to generate an alarm. Alternatively, the boat monitoring logic 81 may transmit a message indicative of the event, and the control logic 63 may decide whether an alarm is to be generated in response to the event. Various other configurations and changes would be apparent to a person of ordinary skill upon reading this disclosure.

The invention claimed is:

1. A boat monitoring system, comprising:

a plurality of boat monitoring elements (BMEs) including at least a first BME mounted on a first boat and a second BME mounted on a second boat, wherein each of the BMEs forms a respective node of a wireless mesh network, and wherein the first BME is coupled to a sensor for sensing an event for the first boat; and a system controller configured to communicate with each of the BMEs via the wireless mesh network, wherein the first BME is configured to transmit a message indicative of the event to the system controller via the wireless mesh network, and wherein the message hops through the second BME before it is received by the system controller.

2. The boat monitoring system of claim 1, wherein the system controller is configured to log the event in response to the message.

3. The boat monitoring system of claim 1, wherein the system controller is configured to transmit a notification via a wide area network (WAN) to a communication device at a remote location in response to the message.

4. The boat monitoring system of claim 1, wherein the system controller is configured to store event data indicating events sensed by sensors on at least the first and second boats, and wherein the system controller is configured to update the event data in response to the message.

5. The boat monitoring system of claim 1, further comprising a repeater forming a node of the wireless mesh network, wherein the message hops through the repeater.

6. The boat monitoring system of claim 1, further comprising a repeater forming a node of the wireless mesh network, wherein the repeater and the first BME are configured to determine a distance between the repeater and the first BME based on at least one message communicated between the first BME and the repeater.

7. The boat monitoring system of claim 1, wherein the system controller is configured to determine whether the first BME is within a predefined proximity and whether the first BME is registered with the system controller, and wherein the system controller is configured to provide a notification if the first BME is determined to be within the predefined proximity but not registered with the system controller.

8. The boat monitoring system of claim 1, wherein the sensor is configured to sense a parameter indicating whether the first boat is on fire.

9. The boat monitoring system of claim 1, wherein the sensor is configured to sense a parameter indicating whether the first boat is sinking or listing.

10. The boat monitoring system of claim 1, wherein the sensor is configured to sense electrical current in water in which the first boat is floating.

11. The boat monitoring system of claim 1, wherein the sensor is configured to sense when acceleration of the first boat exceeds a predefined threshold.

12. The boat monitoring system of claim 1, wherein the sensor is configured to sense whether an intruder is on the first boat.

13. The boat monitoring system of claim 1, wherein the sensor is configured to sense a parameter indicative of an operation of a bilge pump on the first boat.

14. The boat monitoring system of claim 13, further comprising logic configured to determine a value indicative of an amount of usage of the bilge pump over time, and wherein the logic is configured to compare the value to a threshold.

15. The boat monitoring system of claim 1 further including a plurality of location sensors, each one of the BMEs receiving a location data from an associated location sensor, the location data corresponding to a location of the respective boat, and said system controller comparing the location data received from each BME with a region of interest to determine if any one of the BMEs is outside the region of interest.

16. The boat monitoring system of claim 1 wherein the system controller determines if any one of the BMEs is outside a region of interest by comparing a signal strength of a signal received from each of the BMEs with a preselected value, wherein the signal strength associated with any one of the BMEs that is less than the preselected value indicates that the one BME is outside the region of interest.

17. A boat monitoring method, comprising:

sensing a first event for a first boat via a first sensor mounted on the first boat;

sensing a second event for a second boat via a second sensor mounted on the second boat;

transmitting a first message indicative of the first event from a first boat monitoring element {BME) mounted on the first boat to a system controller via a wireless mesh network;

transmitting a second message indicative of the event sensed via the second sensor from a second BME mounted on the second boat to the system controller via the wireless mesh network, wherein each of the first and second BMEs forms a respective node of the wireless mesh network, and wherein the first message hops through the second BME before it is received by the system controller; and providing a notification indicative of the first event via the system controller.

18. The method of claim 17, further comprising transmitting the notification via a wide area network (WAN) to a communication device.

19. The method of claim 17, further comprising:

storing, in memory, event data indicating events sensed by sensors on at least the first and second boats; and updating the event data via the system controller in response to the first and second messages.

20. The method of claim 17, further comprising:

communicating messages between the first BME and a repeater of the wireless mesh network; and determining a distance between the first BME and the repeater.

21. The method of claim 17, further comprising:

determining whether the first BME is within a predefined proximity;

determining whether the first BME is registered with the system controller;

providing a notification if the first BME is determined to be within the predefined proximity but not registered with the system controller.

22. The method of claim 17, further comprising determining whether the first boat is on fire based on the first message.

23. The method of claim 17, further comprising determining whether the first boat is sinking or listing based on the first message.

24. The method of claim 17, further comprising determining whether electrical current in water in which the first boat is floating exceeds a threshold based on the first message.

25. The method of claim 17, further comprising determining whether acceleration of the first boat exceeds a predefined threshold based on the first message.

26. The method of claim 17, further comprising determining whether an intruder is on the first boat based on the first message.

27. The method of claim 17, wherein the first event is associated with an operation of a bilge pump on the first boat.

28. The method of claim 17, further comprising:

determining a value indicative of an amount of usage of the bilge pump over time;

comparing the value to a threshold; and providing a notification based on the comparing.

29. A boat monitoring system, comprising:

a plurality of boat monitoring elements (BMEs) including at least a first BME mounted on a first boat, a second BME mounted on a second boat, and a third BME mounted on a third boat, wherein each one of the BMEs forms a respective node of a wireless mesh network, and wherein the first BME senses an event for the first boat; and a controller configured to communicate with each of the BMEs via the wireless mesh network, the first BME being configured to transmit a message indicative of the event to the controller via the wireless mesh network, and wherein the message passes through the second BME before the message is received by the controller unless the second BME is not within a wireless range of the first BME, in which case the message passes through the third BME before the message is received by the controller.

* * * * *